United States Patent [19]

Hirbod

[11] Patent Number: 4,929,287

[45] Date of Patent: May 29, 1990

[54] METHOD FOR SURFACE TREATMENT OF METAL ALLOYS

[75] Inventor: Modjtaba Hirbod, Finspong, Sweden

[73] Assignee: ABB Stal AB, Sweden

[21] Appl. No.: 247,640

[22] Filed: Sep. 22, 1988

[30] Foreign Application Priority Data

Jun. 13, 1988 [SE] Sweden ..... 8802186

[51] Int. Cl.[5] ..... C23F 17/00; C23C 8/10

[52] U.S. Cl. ..... 148/276; 148/280; 148/285; 148/286

[58] Field of Search ..... 148/276, 285, 286, 280

[56] References Cited

U.S. PATENT DOCUMENTS 1,362,213 12/1920 Andrews .
3,883,370 5/1975 Kanter .

FOREIGN PATENT DOCUMENTS 0181192 5/1986 European Pat. Off. .
3145236 11/1984 Fed. Rep. of Germany .
595459 9/1977 Switzerland .

OTHER PUBLICATIONS

Patent Abstracts of Japan, vol. 9, No. 247, abstract of JP 60-103173, publ. Jul. 6, 1985.

*Primary Examiner*—Sam Silverberg
*Attorney, Agent, or Firm*—Watson, Cole, Grindle & Watson

[57] ABSTRACT

A method for improving the corrosion/erosion resistance of Fe-based, Co-based, or Ni-based alloys included in power plants for combustion in a a fluidized bed. The method is characterized in that the surface of the metal alloy is treated in a multi-step combination treatment to provide an adherent and protective surface layer.

11 Claims, No Drawings

METHOD FOR SURFACE TREATMENT OF METAL ALLOYS

TECHNICAL FIELD

The invention relates to the field of methods for improving the corrosion/erosion resistance of a high-temperature metal alloy in systems included in power generating plants for combustion in a fluidized bed by surface treatment of the metal alloy.

BACKGROUND ART

It is known to improve the corrosion resistance of high-temperature metal alloys, intended for internal components in combustion chambers and the like, by adding small amounts of some rare earth metal to the alloy. A disadvantage with this method is that also the strength could be influenced by the alloy additive. For land-based gas turbines and the like, it is common to provide high-strength alloys with protective surface layers. Swedish patent No. SE 7711357 describes how the corrosion resistance of a high-temperature alloy is increased by applying a surface layer by means of electrochemical deposition. The surface layer consists of a coherent matrix of Co or Ni with discrete particles containing some added substances from the group Cr, Si, Al, Ti, Ta, Be or a rare earth metal. Protective layers containing Al, Pt, Cr, Y, Sc, B and spraying of layers of Cr, Al with small additives of Y, Zr, Hf, or a rare earth metal, are also known in the art.

During combustion in a fluidized bed of coal of a varying quality and also other fuels, such as waste from the pulp industry or other waste, wood, peat, oil, brown coal, and the like, combustion gases and ash particles are formed which may have a corrosive and also erosive influence on the construction materials, primarily in the combustion chamber, the ash separator and the gas turbine. A corrosive effect from formed $SO_3$ may lead to the protective surface layer of the metal being broken through by the formation of porous sulphides which are not capable of protecting the metal from further attack, which involves a risk of accelerated erosion attack.

In systems operating under potentially corrosive conditions, it is important to ensure that the construction materials have a good resistance to degradation caused by the attack of corrosion and erosion.

DISCLOSURE OF THE INVENTION

The invention relates to a method for improving the resistance to corrosion and erosion attacks on construction materials included in combustion chambers, cyclones and gas turbines in power plants with combustion in a fluidized bed. The constuction materials are primarily low-alloy or high-alloy high-temperature steels or alloys based on Co or Ni. During combustion of coal in a fluidized bed, lime (CaO) or dolomite ($CaMg(CO_3)_2$) is added to bind sulphur (S) in the flue gas. This leads to the formation of anhydrite ($CaSO_4$) which may become deposited on internal surfaces. A greatly contributory cause of the attack of corrosion on the construction materials is the formation of $SO_3$ which may lead to sulphide attack on the materials. To improve the resistance of the construction materials to corrosive and erosive attacks, it is possible, in accordance with the invention, to improve the surface layers of the materials by treating the surface in a multi-step combination thus obtaining a surface layer which is thin and adherent and protects the metal without influencing the strength of the material. The method is applicable to alloys which are based on Fe, Co or Ni and which contain Cr and/or Al. The method comprises (a) causing the material first to oxidize selectively, for example by heating the material at 500°–1200° C. in an atmosphere of air or hydrogen, air, argon, nitrogen or helium mixed with water vapour. Thereafter (b) a substance is added which contributes to increase the ductility and adhesitivity of the oxide layer, such as a rare earth metal, for example Ce or Y, or Si, B, Al, Ta, Pt, Zr, Hf, Cr, Nb, Ti or Mg. Mixtures or compounds containing at least one of these substances can also be used. The addition can be performed by immersing the material in a slurry or the like, which contains any of the above-mentioned substances, or by some form of electrolytic, electrochemical, or chemical deposition of any of the substances on the surface of the material. Spray depositing on the material surface of a solution or mixture, containing any of the above-mentioned substances, can also be performed. It is an advantage if the material is hot; preferably a temperature within the range 500°–1200° C. is maintained, as during the preceding heat treatment, or a somewhat lower temperature considering the fact that the material cools during the transport and in view of the waiting times between the steps in the surface treatment. To achieve an improved incorporation of an added substance and to further strengthen the oxide layer, a further heat treatment of the surface is preferably carried out at 500°–1200° C. in an atmosphere of air, moist air, oxygen gas, nitrogen gas or mixtures thereof, after the application of the additive. One or more of the steps in the surface treatment can be carried out repeatedly. By surface treatment in three steps, a surface layer is obtained which is relatively thin ($\leqq 20\ \mu m$), has good adhesion to the metal and has good ductility. Contrary to other methods in which additives are applied on metal surfaces, a three-step surface treatment provides very thin oxide layers in which the added substance is well incorporated. The third step (c) entails an improved method of ensuring that the added substance is incorporated into the surface layer without the thickness of the surface layer exceeding 20 $\mu m$. The treatment according to the invention provides a considerable improvement of the ability of the metal to withstand the attack of corrosion and erosion in an environment characteristic of coal combustion in a fluidized bed. In addition, the surface layer can be rapidly applied and does not influence the strength of the metal.

DESCRIPTION OF A PREFERRED EMBODIMENT

EXAMPLE 1

To improve the corrosion/erosion resistance of a binary austenitic Fe-based alloy, for example 2338, which is subjected to flue gases containing, inter alia, sulphur compounds, a threestep surface treatment is carried out. Prior to the surface treatment, the metal surface is carefully cleaned, possibly blasted if this should be necessary. In the first step (a) of the surface treatment, the object is heated in a furnace at a temperature of 500°–700° C. in an atmosphere of hydrogen gas and water vapour for about 5–30 minutes to obtain a selective oxidation of chromium on the surface of the alloy. Thereafter, the object is immersed, while still hot, into a slurry of cesium nitrate and alcohol. After drying the surface in air, the third step (c) of the surface treatment is carried out by heating the object to 500°–700° C. in air to convert the nitrate into oxide and to further strengthen the oxide layer. After completed surface treatment, the thickness of the oxide layer is about 10–20 μm.

EXAMPLE 2

Surface treatment of Ni-based or Co-based superalloys containing Al can be carried out as described in Example 1. During heat treatments (a) and (c), however, it is advantageous to raise the temperature to about 1000°–1200° C. In the second step (b), one or more of the substances specified in claim 5, e.g. yttrium, can be added and thereafter step (a) can be repeated before step (c) is carried out. For superalloys containing Cr, steps (a) and (c) can be carried out at 800°–950° C.

The method as described above can be varied in many ways within the scope of the following claims.

I claim:

1. A method for improving the corrosion/erosion resistance of a high-temperature Fe, Co or Ni-based alloy having a surface that is exposed to combustion products of coal, coal products, waste or the like and which contains a metal selected from the group consisting of Cr and Al, said method comprising the steps of (a) heating the surface of said alloy to a temperature between 500° and 1200° C. to selectively oxidize Cr and Al at said surface to form an oxide layer, (b) applying a substance to said oxide layer to promote adhesion and ductility of said oxide layer, and (c) subjecting said surface to an elevated temperature in an environment adapted to facilitate incorporation of said substance into said oxide layer, thereby providing an oxide layer having a thickness which does not exceed 20 μm.

2. A method according to claim 1, wherein in step (b) said surface is immersed in a slurry containing said substance.

3. A method according to claim 2, wherein said surface is hot when immersed in said slurry.

4. The method according to claim 1, wherein in step (b) said substance is electrolytically deposited on said surface.

5. The method according to claim 1, wherein in step (b) said substance is sprayed onto said surface.

6. The method according to claim 1, wherein said substance includes an element selected from the group consisting of Si, B, Al, Ta, Pt, Zr, Hf, Cr, Nb, Ti, Mg, Ce and Y.

7. The method according to claim 6, wherein said substance is in the form of an oxide.

8. The method according to claim 6, wherein said substance is in the form of a nitrate.

9. The method according to claim 1, wherein step (a) takes place in a moist atmosphere containing a gas selected from the group consisting of hydrogen, argon, nitrogen, helium and air.

10. The method according to claim 1, wherein step (c) is carried out at 500° to 1200° C. and wherein said environment consists of an atmosphere selected from the group consisting of air, moist air, oxygen gas and nitrogen gas.

11. A method according to claim 1, wherein at least one of steps (a), (b) and (c) is repeated at least once.

* * * * *